US005185971A

United States Patent [19]

Johnson, Jr.

[11] Patent Number: 5,185,971

[45] Date of Patent: Feb. 16, 1993

[54] CHANNELED WALL PANEL

[76] Inventor: Hugh L. Johnson, Jr., 2297 Dunwoody Crossing, Atlanta, Ga. 30338

[21] Appl. No.: 702,069

[22] Filed: May 17, 1991

[51] Int. Cl.[5] ..... A47B 5/00

[52] U.S. Cl. ..... 52/36; 52/282; 211/94; 248/222.1; 248/243

[58] Field of Search ..... 52/36, 731, 732, 281, 52/282, 588, 283; 211/87, 94; 108/102, 108, 42, 152; 248/243, 225.1, 222.1, 221.2

[56] References Cited

U.S. PATENT DOCUMENTS

| | | | |
|---|---|---|---|
| 2,933,196 | 4/1960 | Childs | 248/243 X |
| 3,782,048 | 1/1974 | Corman | 52/282 X |
| 4,086,978 | 5/1978 | Clements | 52/36 X |
| 4,159,814 | 7/1979 | Fibus | 248/243 |
| 4,570,390 | 2/1986 | Wendt | 248/243 X |
| 4,615,448 | 10/1986 | Johnstonbaugh | 211/87 X |
| 4,629,076 | 12/1986 | Amstutz et al. | 211/87 X |
| 4,708,311 | 11/1987 | Clausen et al. | 211/87 X |
| 4,944,416 | 7/1990 | Petersen et al. | 211/87 X |

FOREIGN PATENT DOCUMENTS

| | | | |
|---|---|---|---|
| 6617424 | 6/1967 | Netherlands | 248/243 |
| 792636 | 11/1955 | United Kingdom | 108/108 |

*Primary Examiner*—David A. Scherbel
*Assistant Examiner*—Creighton Smith
*Attorney, Agent, or Firm*—Kilpatrick & Cody

[57] ABSTRACT

Channels and panels for walls and other surfaces, for use in applications such as retail display. The panels feature slots and channels within the slots. The channels in turn support brackets and other fixtures which may be used to suspend materials from the wall or surface. Channels of the present invention, unlike conventional channels, have no back surface, when viewed in cross section, but instead feature closed front faces. A first embodiment of such channels features flanges with rounded extremities, a closed face similar in appearance to conventional vertical slotted channels, and a structure which reduces the amount of material required. A second embodiment of such channels features an open back structure and flange protrusions to increase the load bearing capacity of the channels.

17 Claims, 3 Drawing Sheets

CHANNELED WALL PANEL

The present invention relates to devices for attaching supports, suspension devices, displays and other structural items to panels, walls and other surfaces.

BACKGROUND OF THE INVENTION

Rising real estate costs, higher rent and interest rates, higher maintenance costs, and similar factors require that homeowners and businesses become more efficient in their use of space. Such efficiency requires employment of previously unused space, and it typically requires flexibility in the manner in which space is employed.

An example of new approaches to efficient space use involves the use of channeled wall panel in retail establishments. The recent requirement in retail marketing, such as clothing and shoe stores, for rapid turnover of merchandise resulting from the high inventory costs, combined with ever changing product lines and styles, requires attractive, efficient and very flexible display capacity. Channeled wall panel is a conventional answer to this problem. Channeling within the panel into which support or display members may be inserted as desired allows efficient use of wall space in an attractive, flexible and efficient manner.

Typical channeled wall panel includes J- or T-cross section shaped slots which have been routed or otherwise formed below the exposed surface of the panel with the throat of the J or T open to the exposed surface. Extruded structural members of corresponding cross-section are typically inserted into the slots to finish the structure. Portions of the panel between the surface of the panel and the flanges of the structural members (base of the J or top of the T) absorb the loads placed on the structural members by hangers, display racks, or other devices attached to the structural members.

Conventional channels are generally tubular in cross section and hollow extruded material forms a generally flat back surface, curves around to form the front surfaces of the two flanges generally parallel to the back surface, and then turns generally perpendicular to the back surface to form the open throat of the structural member. Recent adaptations include small protrusions that extend from the flanges generally parallel to the back surface in order to increase the cross sectional area of panel material between buried channel and the surface of the panel, and thus to increase the holding power of the channel.

SUMMARY OF THE INVENTION

Channels according to the present invention include no back surface. They instead feature a closed throat. These new closed face channels give the panel the appearance of a wall with conventional U-shaped slotted channel, and allow use of hangers, display members and other de:,ices which are conventionally made for such conventional channel. Yet the new closed-face channeling of the present invention allows far greater load-bearing capacity than channel simply attached to the wall by screws, because its embedded flanges add far greater structural support.

In a first embodiment of the present invention, the channel flanges feature rounded extremities which serve to increase the panel mass between the flanges and the exposed panel surface. The top of the T is open, and the throat of the channel features a closed exposed face with linear slots. The flanges are thus supported and connected to one another structurally via the closed face. The use of a closed face with linear slots allows the channel to be installed either vertically or horizontally and to accommodate other hardware and fittings manufactured for conventional U-shaped channels which are bolted or screwed to walls.

A second embodiment of the present invention combines the closed face and open flanges of the first embodiment with protrusions extending from the flanges in order to yield a strong, versatile support structure with greater load bearing capacity.

It is accordingly an object of the present invention to provide a channeled panel with increased load-bearing capabilities, which can be manufactured with less material without loss in strength, and which allows efficient use of space in an attractive manner through versatility and maximum strength with minimum use of metal and expense.

Other objects, features and advantages of the present invention will be apparent from the remainder of this document.

DETAILED DESCRIPTION OF THE DRAWINGS

Figure 1:
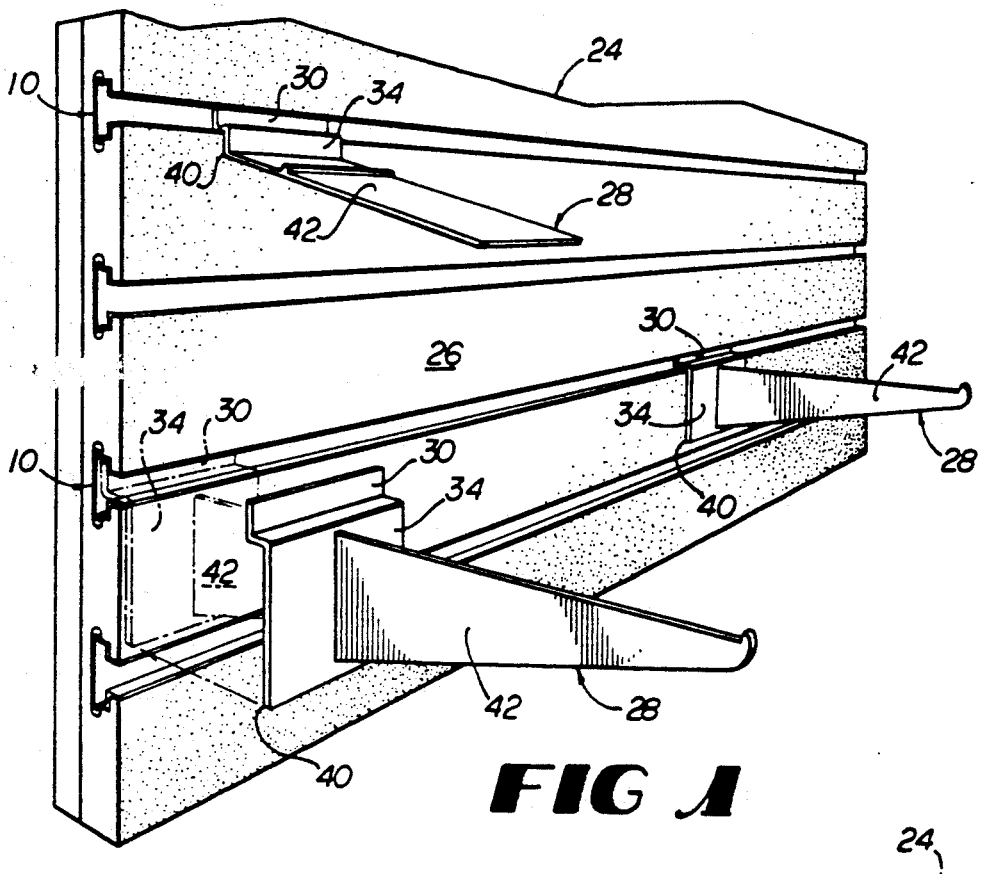
FIG. 1 is a perspective view of a panel incorporating conventional channel with flange protrusions showing an end of a panel in section, two brackets inserted into the channel and a third bracket exploded from the channel.
Figure 2:
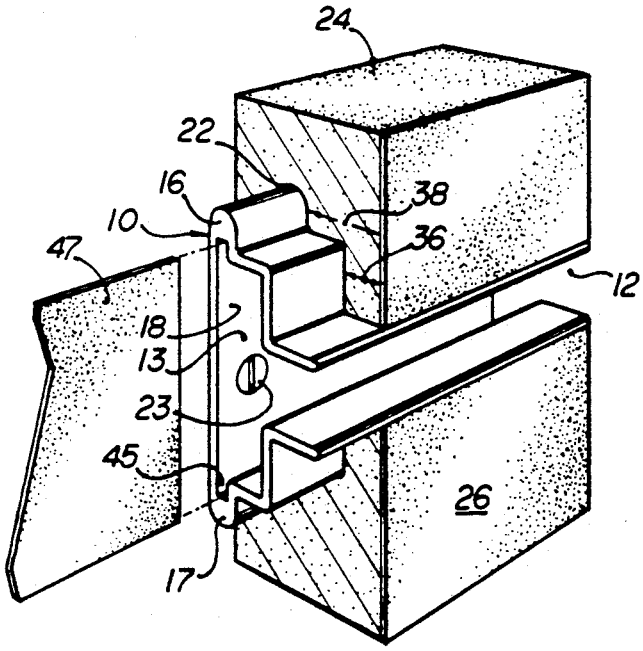
FIG. 2 is a perspective partial cross-sectional view of the panel of FIG. 1 showing a single channel in section and a channel insert exploded from the channel.
Figure 3:
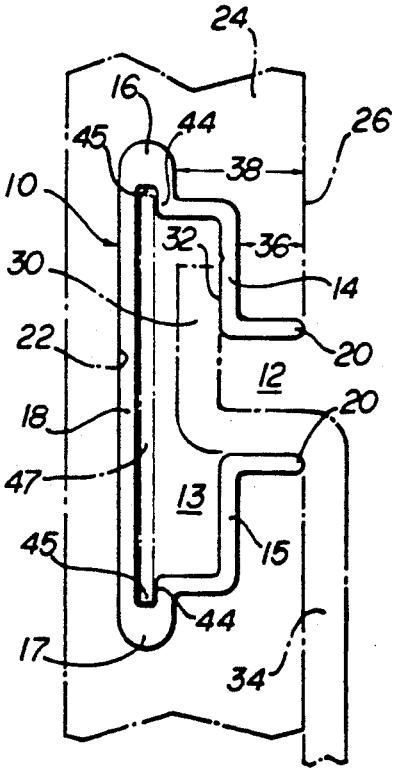
FIG. 3 is a side cross-sectional view of the channel of FIG. 1 with a bracket hook.

FIGS. 1, 2 and 3, show a conventional channel designated by numeral 10. Channel 10 is generally T-shaped and has a hollow interior 13. The interior 13 communicates with the exterior of channel 10 through open throat 12 which extends from flanges 14 and 15 and terminates at lips 20. The top, or cross member, of channel 10 is formed by flanges 14 and 15, which project perpendicularly outward from throat 12, and by protrusions 16 and 17, which project from flanges 14 and 15 and are connected by bookplate 18. Channel 10, and channels 10 of the present invention, may be unfinished, anodized or painted extruded aluminum or plastic; other suitable materials (extruded or non-extruded) can also be used.

Channel 10 is received in slot 22, which is of a substantially similar cross section as channel 10, so that bookplate 18 is planar with front surface 26 of panel 24 and lips 20 are substantially flush with front surface 26. Once installed in slot 22, channel 10 is prevented from sliding within slot 22 by screws or other fasteners 23. Panel 24 may be, conventionally and according to the present invention, plywood, particle board, tempered hardboard or fiberboard and front surface 26 may have a variety of finishes such as wood veneer, paint, plastic laminate, mirrored plexiglass or fabric. Shoulders 44, defined by the intersection of flanges 14 and 15 with protrusions 16 and 17, respectively, form slots 45 that permit a decorative insert 47, such as a strip of plastic laminate or wood veneer, to be threaded into and held within hollow interior 13 of channel 10 so that the insert 47 covers screws 23 and is visible through throat 12.

As can be seen in FIGS. 1 and 3, in use, hook 30 on a conventional bracket 28 is inserted into throat 12 of channel 10 so that hook 30 enters hollow interior 13 through throat 12 and engages the interior side 32 of flange 14 and plate 34 rests against front surface 26 of panel 24. When a load is applied to bracket 28, the load is transmitted to panel 24 by lever arm 42 on bracket 28 and hook 30 acting through flanges 14, protrusions 16 and 17 and bookplate 18. Lower point 40 on plate 34 is the fulcrum around which the load tends to cause bracket 28 and channel 10 to rotate.

Upper flange retaining lip 36 of panel 24 cantilevers over and is engaged by upper flange 14 and upper protrusion retaining lip 38 of panel 24 cantilevers over and retains upper protrusion 16. Referring to FIG. 3, addition of protrusions 16 and 17 in a conventional manner greatly increases channel 10's resistance to being sheared or rotated out of panel 24 when great loads are applied. For such failure to occur, protrusions 16 and 17 would be required to penetrate through retaining lips 38, which are approximately twice as thick as the thinner lips 36 through which flanges 14 and 15 must shear for failure to occur. (Additionally, obviously, flanges 14 and 15 would be required to shear through thinner lips 36 and screws 23 would need to shear off or pull out of panel 24 for failure to occur.) Thus, mere addition of seemingly minor structural elements to the flanges greatly increases the mass and volume of panel material restraining channel 10 in the panel 24, and thus greatly increases the load-bearing capacity of the channel 10 and the panel 24. Furthermore, the protrusions 16 and 17 greatly increase resistance to failure by increasing the bending moment which must be applied to channel 10 in order for failure to occur as by, for instance, flange 15 acting as a fulcrum and flange 14 rotating through lip 36.

Both sets of lips 36 and 38 also resist rotational movement of channel 10 within slot 22. However, more importantly, lips 38 of panel 24, being thicker than lips 36, better resist rotational movement of protrusions 16 and 17 and channel 10, thereby increasing the load-bearing capacity of channel 10 and panel 24. The protrusions 16 and 17 also lengthen the moment arm of resistance that channel 10 imparts to external loads and elongate bookplate 18 of channel 10, thereby compressing a larger portion of panel 24, which in turn increases the load-bearing capacity of channel 10 and panel 24.

Figure 4:
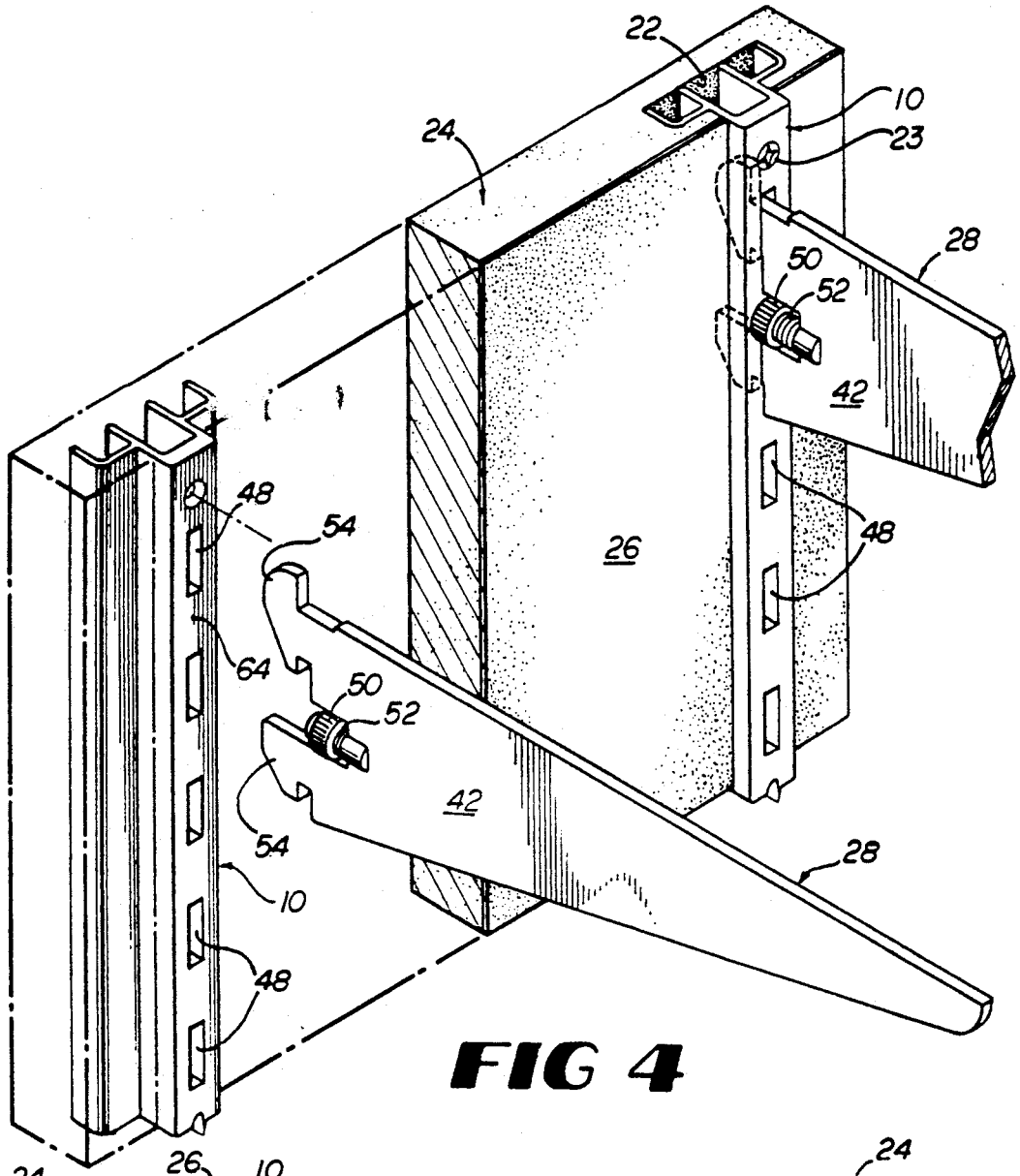
FIG. 4 is a partial cross-sectional view of a panel incorporating a first embodiment of channel of the present invention with rounded flanges.
Figure 5:
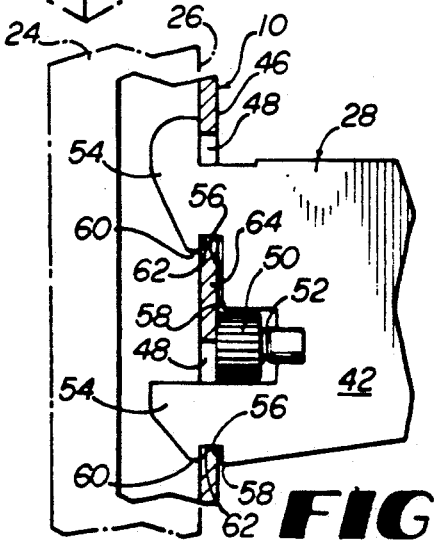
FIG. 5 is a side cross-sectional view of the panel of FIG. 4 showing portions of a bracket placed in the channel.
Figure 6:
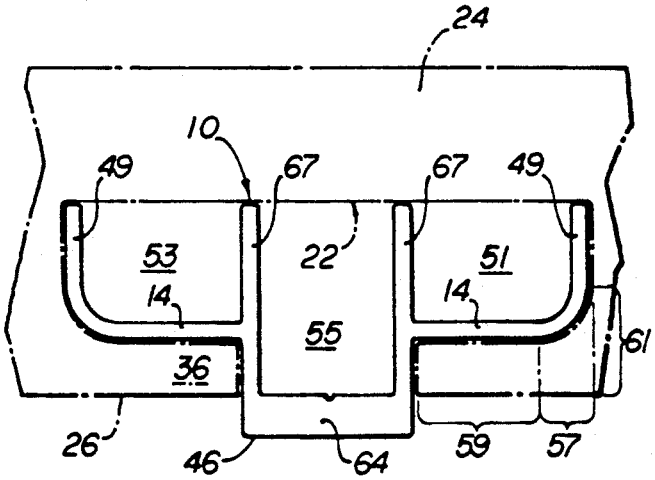
FIG. 6 is a cross-sectional view of the channel of FIG. 4.

FIGS. 4, 5 and 6 show a first embodiment of channel of the present invention with nc bookplate. In that embodiment, channel 10 is generally T-shaped, contains flanges 14, is received in slot 22 in panel 24 and is prevented from sliding within slot 22 by screws 23. Channel 10 is also generally hollow, but is open in the back and features a solid front face 46 having slots 48 which structurally connects the flanges 14 and 15 together. Slots 48 may be of any suitable length but ½" to 1" slots are preferred. Slot 22 is located so that face 46 preferably protrudes slightly beyond front surface 26 and flanges 14 are planar with front surface 26.

The channel 10 of FIGS. 4–6 in some senses resembles two small figure "h's" back to back connected by face 46. This structure results in considerable material savings necessary to manufacture channel 10, because no material across the back side of channel 10 (such as back 18 shown in FIG. 3) is necessary. Instead, structural integrity of the channel 10 is maintained through action of three box teams formed by the extrusion. Two flange boxes 51 and 53 are formed by flange supports 49 and inner supports 67, which are, when viewing channel 10 in cross section, oriented substantially perpendicular to front surface 26, and by portions of flanges 14 which are substantially parallel to front surface 26. The third box 51 is formed by inner supports 67 and face 46 of channel 10.

With reference to FIG. 4, consider application of a downward load applied to bracket 28. Bracket 28 in turn applies shearing and bending forces to channel 10 in the vicinity at which its tongues 54 fit in slots 48. Points on the channel 10 above the slots tend to be pulled out of panel 24, but are restrained by flanges 14. Points below the slots tend to be forced into panel 24, however. Inner supports 67 resist such tendency by bearing against the backside of slot 22. Inner supports 67 and flanges 14 thus cooperate in the channel 10 shown in FIGS. 4–6 to provide structural rigidity, and to increase the load-bearing capacity of channel 10 and panel 24.

Flanges 14 are rounded at the corners, according to the embodiment shown in FIGS. 4–6, with a substantial radius of curvature of approximately ¼ or greater the length of flange support 49. Such rounding acts similarly to the protrusions 16 and 17 of the embodiment shown in FIGS. 1–3 by increasing the mass of panel 24 through which flange 14 must penetrate in order for channel 10 to be pulled out of panel 24. Incremental lip 57, in addition to lip 5 (which is present in conventional channels) restrains channel 10. What is significant is the substantially longer edge 61 of incremental lip 57, which represents a considerable depth of panel material which must be penetrated by flange 14 in order for failure to occur.

Bracket 28 used in vertical combination with slotted channel 10 has an arm 42 having L-shaped tongues 54 that are received in slots 48 so that end 56 rests against face 46. Lower portions 60 and slots 62 of tongues 54 snugly engage solid portions 64 of face 46. As can be seen in FIG. 5, once tongues 54 are engaged with solid portions 64, nut 50 on screw 52 is turned so that nut 50 is firmly engaged against face 46, preventing further movement cf tongues 54 within slots 48.

When a load is applied to bracket 28, the load is transmitted to panel 24 by arm 42 on bracket 28 and tongues 54 acting through solid portions 64 of channel 10. Lower points 58 of end 56 is the fulcrum around which the load tends to cause bracket 28 to rotate and channel 10 to bend. Bending of channel 10 is resisted by the inherent rigidity of channel 10 and by lip 36 of panel 24 acting on flanges 14 to resist movement of channel 10.

Figure 7:
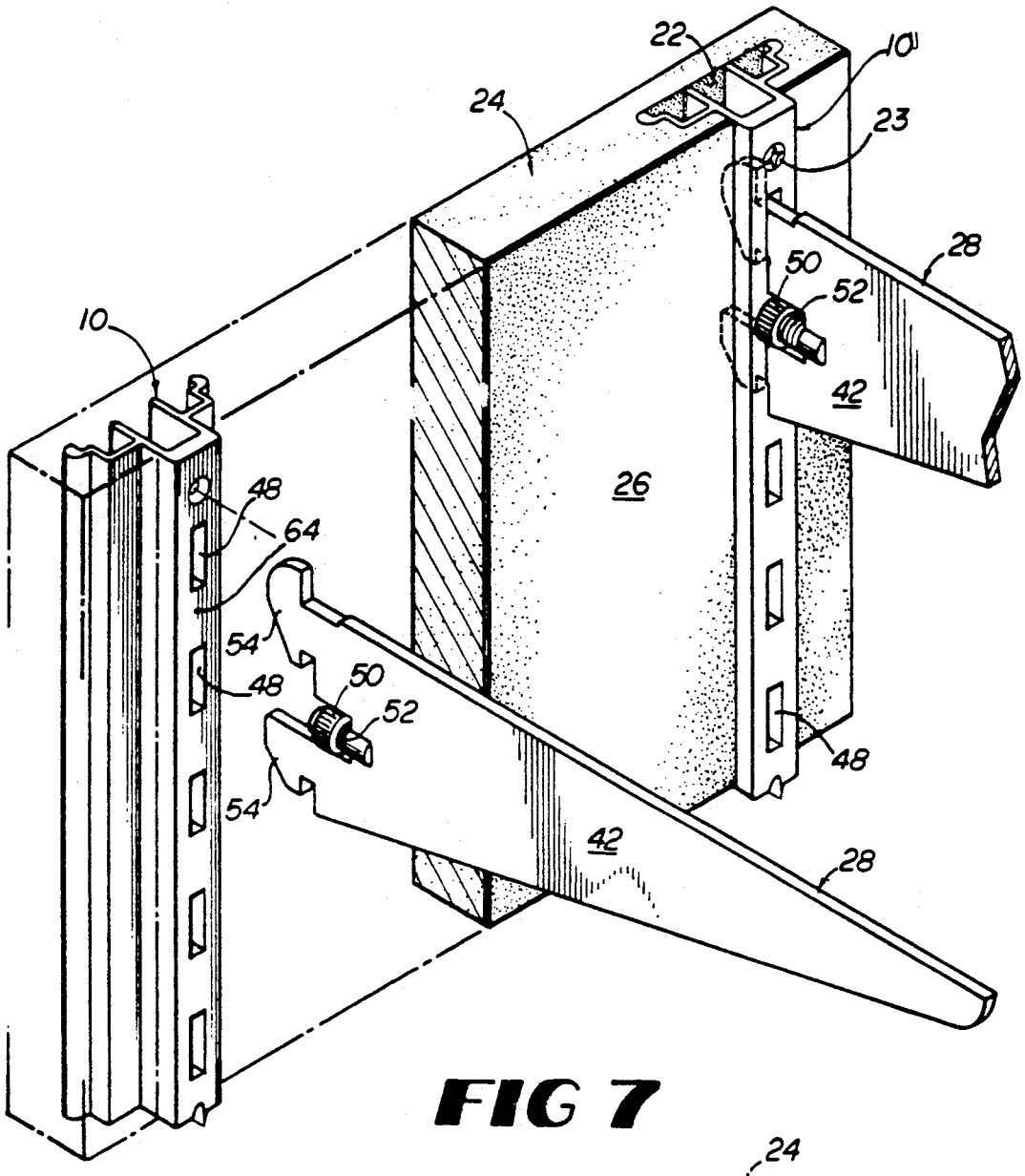
FIG. 7 is a partial cross-sectional view of a panel incorporating a second embodiment of channel of the present invention with flange protrusions.
Figure 8:
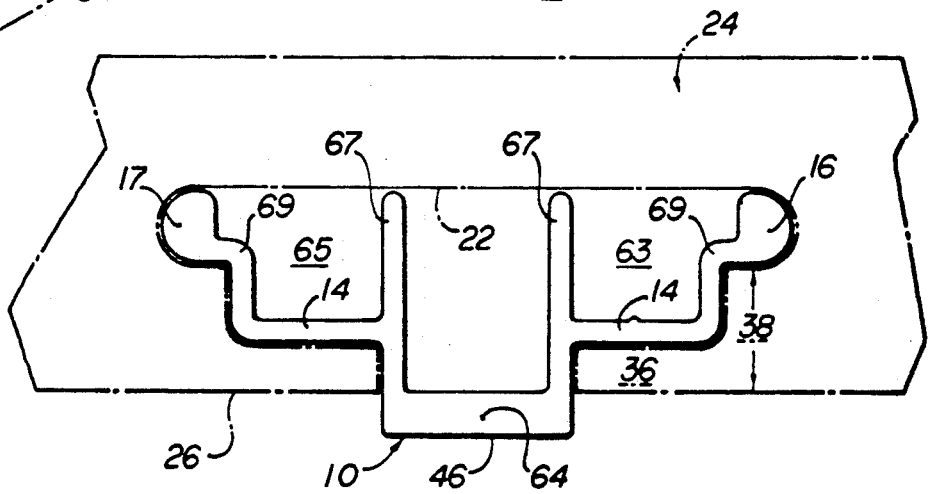
FIG. 8 is a cross-sectional view of the channel of FIG. 7.

A second embodiment of channel 10, as shown in FIGS. 7 and 8, combines flange protrusions with an open back face replaced by the triple box beam structure as in the first embodiment. Once again, the channel 10 may be described as two "h's" placed back to back and connected by face 46. Protrusions 16 and 17 on the extremities of flanges 14 impart increased resistance of channel 10 to bending moments and to being pulled out of panel 24, by adding protrusion retaining lips 38 between channel 10 and the exposed surface of panel 24. The outer two box beams are formed by inner supports 67, flange supports 69 and portions of flanges 14 substantially parallel to exposed surface of panel 24. The inner box is formed of inner supports 67 and face 46. As in the embodiment shown in FIGS. 4–6, inner supports 67 cooperate with flanges 14 to resist failure of channel 10 and panel 24 when loads are applied to brackets 28; they bear against the back of slot 22 while flanges 14 bear against lips 36 and 38.

Channel 10 is installed in slot 22 and bracket 28 is installed in channel 10 in manner similar to that described above and illustrated in FIGS. 5, 7 and 8. Likewise, when a load is applied to bracket 28, the load is transmitted to panel 24 by arm 42 on bracket 28 and tongues 54 acting through solid portions 64 of channel 10. Lower points 58 of end 56 is the fulcrum around which the load tends to cause bracket 28 to rotate and channel 10 to bend. Bending of channel 10 is resisted by the inherent rigidity of channel 10 and by lip 36 of panel 24 acting on flanges 14 in the manner described above. In addition, protrusions 16 increase the rigidity of channel 10 as well as engage lip 38 of panel 24, thereby better resisting bending of channel 10 and increasing the load-bearing capabilities of channel 10.

Although FIGS. 4, 5, 6, 7 and 8 depict first and second embodiments of the present invention in a vertical configuration, it will be apparent to those skilled in the relevant art that other configurations, such as horizontal, can also be used.

The foregoing disclosure and description is provided for purposes of illustration and explanation of a preferred embodiment of the present invention. It will be apparent to those of requisite skill in the relevant art that modifications and changes may be made to the invention described above without departing from its scope and spirit.

What is claimed is:

1. A channel adapted to fit within a slotted wall panel, comprising an elongated extruded member, which, in cross section, includes:

(a) a substantially U-shaped central box member, comprising a face plate adapted to be exposed on and oriented substantially parallel to an exposed surface of the panel, and two box support members extending substantially perpendicular from the face plate, adapted to extend into the panel from the face plate;

(b) a flange member extending from each of the support members, comprising a flange plate connected to one of the support members and extending substantially parallel to the face plate, and a flange support member connected to the flange plate and extending substantially perpendicular to the flange plate, the two box support members and the flange support members being oriented substantially parallel to each other, and terminating in substantially the same plane.

2. A channel according to claim 1 in which the box support members and the flange support members have ends which are substantially collinear.

3. A channel according to claim 1 in which each flange member further comprises a curved portion connecting the flange plate and the flange support member.

4. A channel according to claim 3 in which the radius of curvature of the curved portion of the flange member is greater than one quarter the length of the flange support member.

5. A channel according to claim 1 in which the face plate contains a plurality of slots for receiving hardware.

6. A channel adapted to fit within a slotted wall panel, comprising an elongated extruded member, which, in cross section, includes:

(a) a substantially U-shaped central box member, comprising a face plate adapted to be exposed on and oriented substantially parallel to an exposed surface of the panel, and containing a plurality of slots, and two box support members extending substantially perpendicular from the face plate, adapted to extend into the panel from the face plate;

(b) a flange member extending from each of the support members, comprising a flange plate connected to one of the support members and extending substantially parallel to the face plate, a curved portion connected to the flange plate, and a flange support member connected to the curved portion and extending substantially perpendicular to the flange plate, the radius of the curved portion of the flange member being greater than one quarter the length of the flange support member;

the two box support members and flange support members being oriented substantially parallel to one another and terminating in substantially the same plane.

7. A channel adapted to fit within a slotted wall panel, comprising an elongated extruded member, which, in cross section, includes:

(a) a substantially U-shaped central box member, comprising a face plate adapted to be exposed on and oriented substantially parallel to an exposed surface of the panel, and two box support members extending substantially perpendicular from the face plate, adapted to extend into the panel from the face plate;

(b) a flange member extending from each of the support members, comprising a flange plate connected to one of the support members and extending substantially parallel to the face plate, and a flange support member connected to the flange plate and extending substantially perpendicular to the flange plate; and (c) a pair of protrusions, each extending from a flange support member in a direction away from the box member and substantially parallel to the face plate.

8. A channel according to claim 7 in which the box support members have ends, the protrusions are substantially U-shaped, one leg of the U is connected to a flange support member, and the other leg of the U is substantially collinear with the box support member ends.

9. A channel according to claim 7 in which the face plate contains a plurality of slots for receiving hardware.

10. A channel according to claim 7 in which each flange member further comprises a curved portion connecting the flange plate and the flange support member.

11. A channel according to claim 10 in which the radius of curvature of the curved portion of the flange member is greater than one quarter the length of the flange support member.

12. A channel adapted to fit within a slotted wall panel, comprising an elongated extruded member, which, in cross section, includes:

(a) a substantially U-shaped central box member, comprising a face plate adapted to be exposed on and oriented substantially parallel to an exposed surface of the panel, containing a plurality of slots, and two box support members extending substantially perpendicular from the face plate, adapted to extend into the panel from the face plate;

(b) a flange member extending from each of the support members, comprising a flange plate connected to one of the support members and extending substantially parallel to the face plate, a curved portion connected to the flange plate, and a flange support member connected to the flange plate and extending substantially perpendicular to the flange plate, the radius of the curved portion of the flange member being greater than one quarter the length of the flange support member; and (c) a pair of protrusions, each extending from a flange support member in a direction away from the box member and substantially parallel to the face plate.

13. A panel, comprising a sheet of material having an exposed face, a plurality of slots generally T-shaped in cross section, the throat of the T's exposed to the exposed surface and the base of the T's generally parallel to the exposed face and featuring rounded portions for accommodating rounded portions of the flanges extending from channels adapted to be placed in the slots; and a plurality of channels, each within one of the slots and comprising an elongated extruded member, which, in cross section, includes:

(a) a substantially U-shaped central box member, comprising a face plate adapted to be exposed on and oriented substantially parallel to an exposed surface of the panel and containing a plurality of slots for receiving hardware, and two box support members extending substantially perpendicular from the face plate, adapted to extend into the panel from the face plate;

(b) a flange member extending from each of the support members, comprising a flange plate connected to one of the support members and extending substantially parallel to the face plate, and a flange support member connected to the flange plate and extending substantially perpendicular to the flange plate, the radius of the curved portion of the flange member being greater tan one quarter the length of the flange support member;

the two box support members and flange support members being oriented substantially parallel to one another and terminating in substantially the same plane.

14. A panel according to claim 13 in which the slots are formed vertically in the panel.

15. A panel, comprising a sheet of material having an exposed face, a plurality of slots generally T-shaped in cross section, the throat of the T's exposed to the exposed surface and the base of the T's generally parallel to the exposed face and featuring rounded portions for accommodating rounded portions of the flanges extending from channels adapted to be placed in the slots; and a plurality of channels, each within one of the slots and comprising an elongated extruded member, which, in cross section, includes:

(a) a substantially U-shaped central box member, comprising a face plate adapted to be exposed on and oriented substantially parallel to an exposed surface of the panel, and two box support members extending substantially perpendicular from the face plate, adapted to extend into the panel from the face plate;

(b) a flange member extending from each of the support members, comprising a flange plate connected to one of the support members and extending substantially parallel to the face plate, and a flange support member connected to the flange plate and extending substantially perpendicular to the flange plate;

(c) a pair of protrusions, each extending from a flange support member in a direction away from the box member and substantially parallel to the face plate.

16. A panel according to claim 15 in which the slots are formed vertically in the panel.

17. A panel according to claim 15 in which the slots are formed horizontally in the panel.

* * * * *

UNITED STATES PATENT AND TRADEMARK OFFICE

CERTIFICATE OF CORRECTION

PATENT NO. : 5,185,971

DATED : February 16, 1993

INVENTOR(S) : Hugh L. Johnson, Jr.

It is certified that error appears in the above-identified patent and that said Letters Patent is hereby corrected as shown below:

Column 1, line 41, insert a semicolon after the word "hollow"

Column 4, line 13, delete the word "teams" and insert --beams--

Column 4, line 19, delete "51" after the word "box" and insert --55--

Column 4, line 42, delete "5" after the word "lip" and insert --59--

Column 6, line 17, delete the comma after the word "panel"

Signed and Sealed this

Ninth Day of November, 1993

*Attest:*

Bruce Lehman

BRUCE LEHMAN

*Attesting Officer*

*Commissioner of Patents and Trademarks*